US008818846B2

(12) United States Patent
Robbins et al.

(10) Patent No.: US 8,818,846 B2
(45) Date of Patent: Aug. 26, 2014

(54) GAMING INCENTIVES BASED ON MEASURED EFFECT OF USER WEB ACTIVITY

(71) Applicant: WMS Gaming, Inc., Waukegan, IL (US)

(72) Inventors: Richard B. Robbins, Glenview, ID (US); Jeff D. Fleyshman, Chicago, IL (US); Joel Jaffe, Glenview, IL (US); Andrew Guinn, Chicago, IL (US); Daniel Louie, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/784,905

(22) Filed: Mar. 5, 2013

(65) Prior Publication Data

US 2014/0057701 A1 Feb. 27, 2014

Related U.S. Application Data

(60) Provisional application No. 61/692,971, filed on Aug. 24, 2012.

(51) Int. Cl.

| | |
|---|---|
| ***G06Q 30/00*** | (2012.01) |
| ***A63F 9/24*** | (2006.01) |
| ***G07F 17/32*** | (2006.01) |

(52) U.S. Cl.

CPC ..... *G07F 17/3225* (2013.01)
USPC ..... 705/14.12; 463/25; 463/42; 705/14.19

(58) Field of Classification Search

None
See application file for complete search history.

(56) References Cited

U.S. PATENT DOCUMENTS

| | | | | |
|---|---|---|---|---|
| 8,050,967 | B2 * | 11/2011 | Bistriceanu et al. | 705/14.19 |
| 8,100,758 | B2 | 1/2012 | Walker et al. | |
| 8,131,271 | B2 | 3/2012 | Ramer et al. | |
| 8,316,390 | B2 * | 11/2012 | Zeidman | 725/23 |
| 2002/0083179 | A1 * | 6/2002 | Shaw et al. | 709/227 |
| 2007/0043619 | A1 * | 2/2007 | Leason et al. | 705/14 |
| 2007/0129145 | A1 | 6/2007 | Blackburn et al. | |
| 2007/0173322 | A1 | 7/2007 | Swamy et al. | |
| 2009/0036217 | A1 | 2/2009 | Blackburn et al. | |
| 2009/0170608 | A1 * | 7/2009 | Herrmann et al. | 463/42 |
| 2009/0172035 | A1 | 7/2009 | Lessing et al. | |
| 2010/0087247 | A1 * | 4/2010 | Joshi et al. | 463/29 |
| 2010/0178987 | A1 | 7/2010 | Pacey | |
| 2010/0203963 | A1 * | 8/2010 | Allen et al. | 463/30 |
| 2011/0183749 | A1 * | 7/2011 | Allen et al. | 463/25 |
| 2011/0218044 | A1 | 9/2011 | Joshi et al. | |
| 2011/0320250 | A1 * | 12/2011 | Gemmell et al. | 705/14.16 |
| 2012/0094737 | A1 | 4/2012 | Barclay et al. | |
| 2012/0265603 | A1 * | 10/2012 | Corner et al. | 705/14.39 |
| 2013/0303263 | A1 * | 11/2013 | LeMay et al. | 463/25 |

* cited by examiner

*Primary Examiner* — Dmitry Suhol
*Assistant Examiner* — Jason Yen
(74) *Attorney, Agent, or Firm* — Miller, Matthias & Hull LLP

(57) ABSTRACT

A gaming system includes at least one gaming server having at least one processor and at least one memory device storing instructions. The instructions, when executed by the at least one processor, cause the at least one gaming server to assign one or more unique identifiers to a registrant, monitor for web activity associated with the one or more unique identifiers and initiated by the registrant, measure an effect of the web activity, and convert the measured effect into a gaming incentive.

20 Claims, 3 Drawing Sheets

GAMING INCENTIVES BASED ON MEASURED EFFECT OF USER WEB ACTIVITY

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE DISCLOSURE

The present disclosure relates generally to gaming systems and methods and, more particularly, to converting player activities within social networks and virtual communities into gaming incentives.

BACKGROUND OF THE DISCLOSURE

Electronic gaming services including online contests, sweepstakes, games of chance, wagering games, such as video slots, video poker, and the like, are available for play from various internet based sites. Typically, a provider of such games supports play of the offered games from a host server for a plurality of players that use their computers or mobile devices to connect to the server via the internet. Some such electronic gaming services offer connected players certain gaming incentives for sharing their gaming experiences with others through web activities, such as posts, comments, and the like, made within third-party social networking or virtual communities to promote and advertise the gaming service. Moreover, by increasing the number of references that are made to the gaming service on various social web sites, the overall exposure or viewability of the gaming services can be improved, and among other things, help produce higher ranking search results pertaining to the gaming service.

However, not all web posts and comments are adequately indexable by search engines making it difficult to track or gauge the promotional effects thereof. Furthermore, as is it difficult to track the promotional effect of some such web activities, it is difficult to award different values of gaming incentives which correspond to the promotional benefits effectively received by the electronic gaming service provider. Thus, for these and other deficiencies, a need exists to gauge the promotional effects a web activity and to convert the measured effect into a gaming incentive with a beneficial value corresponding to the measured effect.

SUMMARY OF THE DISCLOSURE

According to one aspect of the present disclosure, a gaming system comprises at least one gaming server having at least one processor and at least one memory device storing instructions that, when executed by the at least one processor, cause the at least one gaming server to assign one or more unique identifiers to a registrant, monitor for web activity associated with the one or more unique identifiers and initiated by the registrant, measure an effect of the web activity, and convert the measured effect into a gaming incentive.

According to another aspect of the present disclosure, a computer-implemented method for a gaming system comprises receiving registrant information from a registrant through one or more input devices of a computational device; assigning one or more unique identifiers to the registrant; measuring an effect of a web activity initiated by the registrant and associated with the one or more unique identifiers; and converting the measured effect into a gaming incentive.

According to yet another aspect of the present disclosure, a tangible machine-readable storage media includes instructions which, when executed by one or more processors, cause the one or more processors to perform the above methods.

Additional aspects of the present disclosure will be apparent to those of ordinary skill in the art in view of the detailed description of various embodiments, which is made with reference to the drawings, a brief description of which is provided below.

Figure 1:
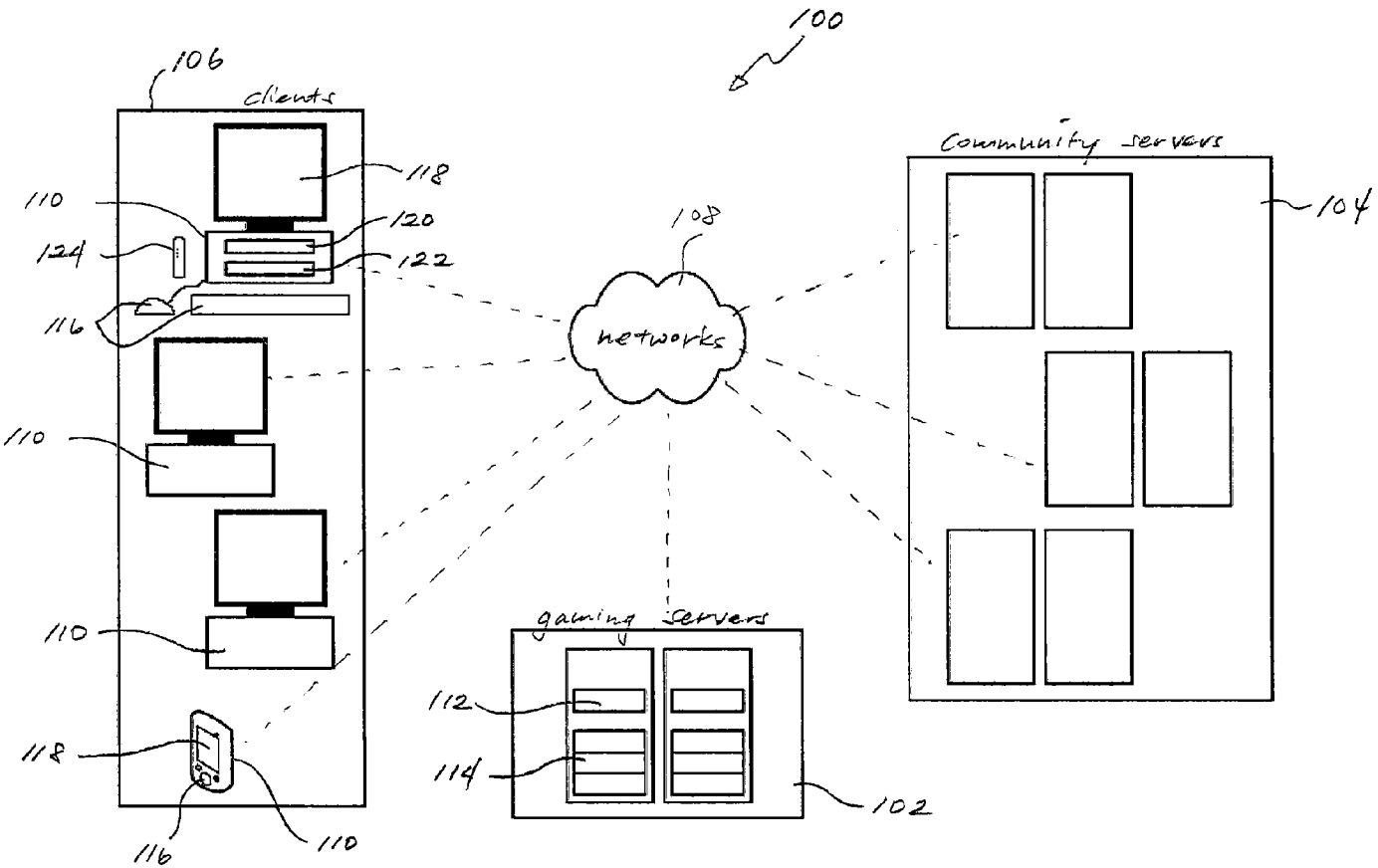
FIG. 1 is a schematic view of a gaming system according to an embodiment of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the appended claims.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. While the present disclosure may be embodied in many different forms, the embodiments set forth in the present disclosure are to be considered as exemplifications of the principles of the present disclosure and are not intended to be limited to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Overall Network

Referring to FIG. 1, one exemplary embodiment of a gaming system 100 is provided. In general, the gaming system 100 may be used to manage and/or facilitate certain interactions between gaming service providers, players or registrants of games of chance provided by the gaming service providers, as well as social and/or virtual communities with which the players or registrants may be affiliated, associated and/or registered. As shown, the gaming system 100 includes at least one or more gaming servers 102, one or more community servers 104, one or more client devices 106, as well as one or more networks 108 electronically communicating information between each of the gaming servers 102, community servers 104 and clients 106. More specifically, the one or more networks 108 provided enable users or registrants at the client devices 106 to access gaming services from the gaming servers 102 as well as social networks and/or virtual communities from the community servers 104.

Gaming Servers

As shown in FIG. 1, the gaming system 100 includes one or more gaming servers 102 which are managed or operated by gaming service providers and configured to enable registered players or registrants to participate in any one or more of a variety of gaming services, such as games of chance, wagering games, contests, sweepstakes, and the like, over the one or more networks 108 provided. Correspondingly, the gaming servers 102 may be configured to manage a plurality of databases including, for example, a registrant database and a gaming service database, among other things. Moreover, as is generally held in the art, each gaming server 102 includes one or more computational devices 110 having at least one processor 112 and at least one memory 114 for storing instructions configured to cause the one or more processors 112 of the gaming server 102 to perform one or more preprogrammed functions or operations.

Community Servers/Networks

The community servers 104 of FIG. 1 may be similarly managed or operated by social networks and include virtual communities, public forums, blogs, and the like. Such community servers 104 typically include databases for not only managing the web-based interfaces associated with one or more online communities, but also for managing databases of information pertaining to registrants or members as well as corresponding member profiles, registration information, user preferences, and the like. As with the gaming servers 102, services of the community servers 104 are accessible to registrants via client devices 106 and through the one or more networks 108 interconnecting the client 106 to the community servers 104. Specifically, the network 108 may take the form of a local area network (LAN), a wireless cellular data network, a wide area network (WAN) such as the internet, or any other suitable network or combination of networks enabling local and/or remote communications between the gaming servers 102, community servers 104 and the clients 106.

Client Devices

As depicted in the embodiment of FIG. 1, the client devices or clients 106 may take any one of a plurality of forms including a mobile device, a cellular phone, a smartphone, a tablet device, a laptop computer, a desktop computer, or any other computational device having at least one input device 116 and at least one output device 118. The input device 116 may include any one or more of a mouse, a keypad, a keyboard, a touchpad, a touchscreen, a microphone, a camera, and any other device enabling the registrant to input information. The output device 118 may include any one or more of a monitor, a display screen, a touchscreen, a speaker, or any other output device enabling a gaming service to be presented to the registrant. The client device 106 also includes one or more processors 120 and at least one memory 122 for storing instructions configured to cause the processor 120 to, among other things, facilitate and/or provide an interface through which a registrant may participate in one or more gaming services sourced by the gaming servers 102 using the input devices 116 and output devices 118. Correspondingly, the client device 106 additionally includes at least one communication device 124, such as a modem, a receiver, a transmitter, a transceiver, a network card, an ethernet card, or any other communication device having wired and/or wireless connectivity with the gaming servers 102 through the one or more networks 108.

Among other things, the client 106 may be configured to communicate with the gaming servers 102 to retrieve gaming service data, display gaming service data, operate a gaming service on the client device 106, and communicate any relevant input provided by the registrant and received through the one or more input devices 116 back to the gaming servers 102. Gaming service data may be initially retrieved from the gaming servers 102 by request of the registrant at the client 106. Specifically, the registrant can initiate the request by navigating a web browser, or the like, within the client device 106 to one or more network or internet addresses associated with and/or managed by the gaming servers 102. Upon receiving the request, the gaming servers 102 communicate gaming service data associated with the desired gaming service through the network 108 to be downloaded, installed and executed on the client device 106. The gaming service data may contain information which once downloaded and installed within the client device 106 creates an interface 126, such as the web-based interface shown in FIGS. 2 and 3, a standalone application-based interface, or the like, that is supported by the operating system of the client device 106, through which the registrant may participate and/or interact with the gaming service.

Client Interface—Registration

Figure 2:
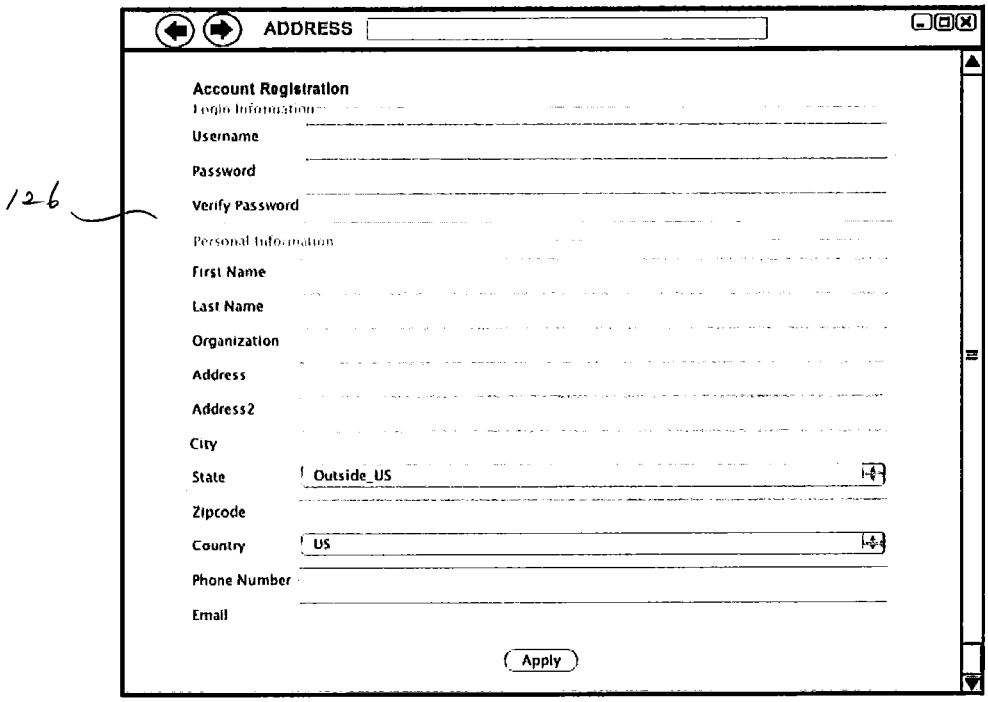
FIG. 2 is an image of an exemplary registration interface for a gaming service displayed on an output device of a client, according to an embodiment of the present disclosure.

The interface 126 provided to the registrant via the client 106 can be configured in a number of different ways to facilitate interactions between the registrant and the gaming service. As shown in FIG. 2 for instance, the interface 126 may be used to receive registration information from a new user so as to register the user with one or more gaming services and to store the registrant information in the database or memory 114 associated with the gaming servers 102. More particularly, the interface 126 may be used to gather information the registrant's name, mailing address, contact information, electronic mailing address, and the like. The registration interface 126 may also enable the registrant to establish a desired alias, username or login, as well as corresponding passwords or other login credentials. Based on the registrant information received, the gaming servers 102 may generate one or more unique identifiers that are unique to the registrant and assign or associate the one or more unique identifiers with the registrant's newly generated account. For example, the unique identifiers may incorporate the alias, username, screen name, electronic mailing address provided by the registrant, or randomly generate an alphanumeric code that is uniquely associated with the registrant. One or more of the unique identifiers may be presented to the registrant via the interface 126 upon registration and/or internally maintained and tracked by the gaming servers 102. In other instances, two or more registrants may be defined or registered within the gaming servers 102 as a group that is participating in one or more gaming services to achieve a common goal. In such cases, the gaming servers 102 may generate a set of unique identifiers to be assigned to those members or registrants of the group so as to track any web activities that are initiated by the individual group members.

Client Interface—Gameplay

Figure 3:
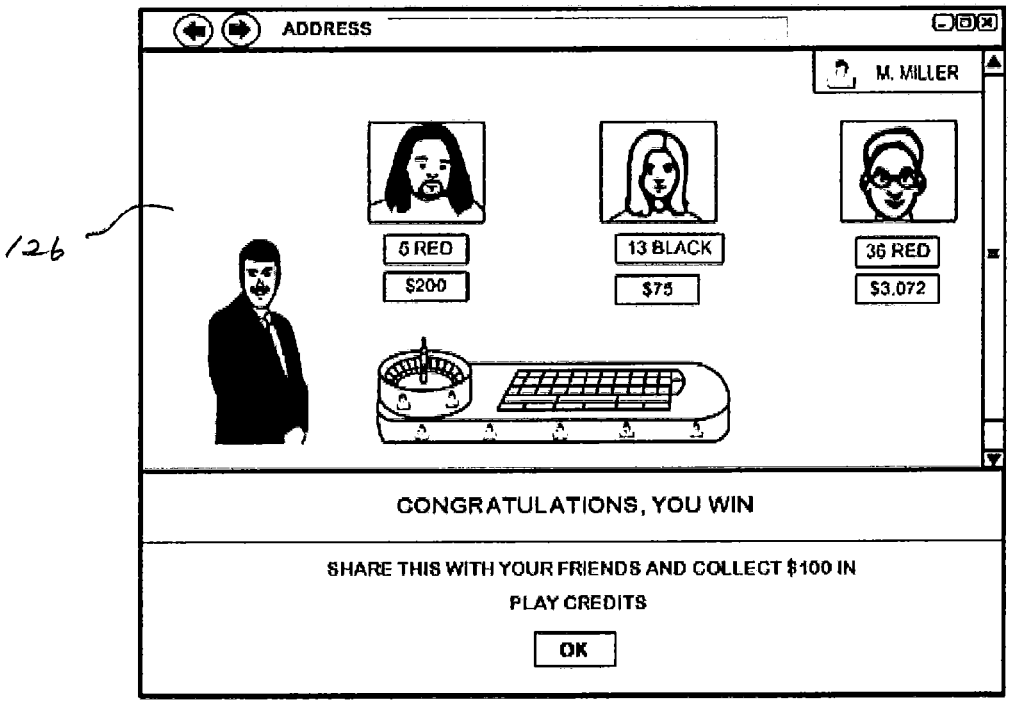
FIG. 3 is an image of an exemplary gameplay interface for a gaming service displayed on an output device of a client, according to an embodiment of the present disclosure.

In addition, the interface 126 can be used to enable gameplay or otherwise facilitate registrant participation with one or more games of chance, wagering games, contests, sweepstakes, or other gaming services provided by the gaming servers 102, as shown in FIG. 3. For example, while displaying images, video, audio, and/or any other media pertaining to gameplay of a particular gaming service, the interface 126 can also be configured to receive various inputs from the registrant during gameplay. Based on the type of client device 106 being used and the types of input devices 116 available to the registrant, for example, the registrant may provide game input using actions such as mouse-clicks, keystrokes, mouse gestures, finger or hand gestures, voice commands, and the like. Such registrant input is read by the client device 106 and used to determine the corresponding actions and/or selections that are desired by the registrant. The relevant actions and/or selections can then be communicated to the respective gaming servers 102 in a manner which enables the registrant to gain entry into contests or sweepstakes, advance through levels or stages of a game of chance, acquire credits, rewards, points, and the like.

Web Activities

While participating with a gaming service or during gameplay, as shown for example in FIG. 3, the registrant may be prompted to initiate a web activity, for example, to share his or her gaming experiences or achievements, or to talk about a particular topic, issue, event, or the like, from within a social network or virtual online community. More specifically, a web activity can include any one or more of a web posting, message, blog, comment, status update, review, rating, or the like, which pertains to a gaming service provided by the gaming services and is viewable by at least other members of the social or virtual community to which the registrant belongs. For instance, the web activity can be used to simply share that the registrant has joined or started playing a particular gaming service, or that the registrant is currently playing a particular gaming service. The web activity can also be used to share the registrant's entry into a contest, an event, a sweepstake, or the like. The web activity can also be used to share other gaming experience attributes, such as the registrant's progress, score, accumulated points, immediate winnings, total winnings, and the like. Although it can be used in association with gaming services, web activities can further be used to share information not relating to a gaming service but rather pertaining to any one or more of a variety of topics, issues, current events, and the like. However, each web activity may be structured such that at least some of the contents thereof are indexable through one or more relevant networks using any one of a variety of scrapers, crawlers, web-based engines, and the like.

In one particular implementation, gaming incentives may be offered to the registrant for initiating and successfully submitting an indexable web activity. More specifically, any time during registration, gameplay, or the like, the interface 126 at the client device 106 can be used to suggest to the registrant that creating and submitting web activities can generate certain gaming incentives for the registrant. Certain rules, requirements, regulations, terms, conditions, and the like, may also be presented to the registrant at such a time. For example, in order to be eligible for a particular gaming incentive, the registrant may be required to make at least certain contents of the web activity indexable and viewable by at least one other member within the social network or virtual community within which the web activity is posted. The registrant can initiate a web activity by directing a web browser, a standalone application, or the like, from within the client device 106 to one or more addresses belonging to one of the social or community servers 104 to which the registrant is registered. For example, the registrant may be able to navigate and login to a blog site, online forum or any other virtual community to post or share a comment regarding a particular gaming service, topic, event, or the like, affiliated by the one or more gaming servers 102.

In alternative modifications, the web activities may be at least partially predefined or automatically generated according to different anticipated achievements throughout a particular gaming service. For example, for each significant achievement that is acquired by the registrant during gameplay or while participating in a gaming service, the interface may prompt the registrant to either allow or deny sharing the achievement with other members of one or more virtual communities to which the registrant belongs. If the registrant chooses not to share his or her achievements, the interface can simply remove the prompt and enable the registrant to return to the gaming service in session or to continue browsing. However, if the registrant allows the interface to share the achievement, the interface may cause the client 106 and the appropriate gaming servers 102 to communicate a predefined web activity to one or more community servers 104 to be shared with one or more virtual communities. Additionally, in order to motivate the registrant to share more achievements and to generate more web activities, the registrant can be given gaming incentives per web activity that is allowed.

Validating Web Activities

For a web activity to be considered valid and eligible for a gaming incentive, the initiated web activity may be required to not only be indexable but also to meet a predefined set of conditions. For example, once a web activity is submitted by a registrant, the gaming servers 102 may be configured to observe the web activity to determine if the contents thereof satisfy a minimum word count, tone, sentence structure, readability, viewability, and the like. The gaming servers 102 may also be configured to observe other qualities or attributes of the web activity to determine validity, such as the site, web page, or type of virtual community through which the web activity was initiated and shared. Upon review, if the gaming servers 102 determine a particular web activity as meeting minimum requirements and as valid, the gaming servers 102 can proceed to issue a gaming incentive that is usable only by the registrant initiating the web activity or otherwise beneficial to the registrant. Specifically, the gaming incentives may be applicable to one or more gaming services provided by the gaming servers 102 and can include, for example, one or more of gaming credits, gaming entries, points, rewards, tokens, play times, prizes, and the like.

Tracking Web Activities

In order to appropriately credit a registrant with gaming incentives for a valid web activity, the gaming servers 102 may be required to monitor or track each web activity initiated by the particular registrant or a group to which the registrant may belong. Web activities which are generated or otherwise initiated by registrants can be tracked by the gaming servers 102 through one or more of the community servers 104 using any one of a variety of indexing, scraping, crawling or otherwise searching means available in the art. For example, the gaming servers 102 can be adapted to track web activities by indexing one or more unique identifiers that have been generated and assigned to the registrants and stored within a database or memory 114 of the gaming servers 102. Specifically, each unique identifier may be generated in a manner which identifies a unique association between the registrant initiating the web activity, the particular gaming service being used or talked about, the gaming service provider, the applicable gaming servers 102, and the like. The gaming servers 102 may also index the various contents of the web activities through the community servers 104 for specific names of gaming services, names of gaming service providers, and the like.

Measured Effects

Still further, the gaming servers 102 may be configured to issue varying values of the gaming incentives based on the measured effect of a particular web activity. In particular, the gaming servers 102 can issue a gaming incentive with greater beneficial value to those registrants initiating web activities which are viewable to a greater number of people, are presented within communities with higher ranks, greater popularity or more web traffic, exhibit more interaction with other members of the social or virtual community, and the like. For example, the gaming servers 102 may be configured to not only track and determine the validity of web activities that have been initiated by its registrants, but to gauge the effectiveness or likelihood of the web activity to reach more members within the online community and to benefit the gaming service providers in doing so. The gaming servers 102 can also gauge various factors or traits of a web activity against one or more predefined rule sets to assess the effective quality of the web activity. Any assessment results, outputs of the rule sets, or derivations therefrom, can then be at least partially applied to one or more of the gaming services provided through the gaming servers 102 by a gaming service provider.

Accordingly, the gaming servers 102 may observe various predefined metrics to quantify the measured effect of a particular web activity. As one example, specialized algorithms or subroutines can be created within and applied by the gaming servers 102 to assess the effective quality of a web activity based on the detected tone of one or more messages and/or sentences contained within the web activity. The gaming servers 102 can also be preprogrammed with filters which monitor for and detect certain keywords, punctuations, font types, text sizes, word sequence, sentence structure, phrases, and the like, that are indicative of a web activity with a higher level of quality as defined by rule sets preprogrammed within the gaming servers 102. Similarly, other specialized techniques can be used by the gaming servers 102 to gauge the effective quality of a web activity.

In other modifications, the gaming servers 102 can be adapted to observe not only the web activity's word count, tone or sentence structure, but may also assess one or more of the web activity's view count, the page rank of the social or virtual community within which the web activity was submitted, the viewability of the web activity, members' response to the web activity, and the like. For example, the gaming servers 102 can be programmed to wait for a predefined duration of time before assessing the measured effect of a new web activity to allow time for other members with the community to respond to the web activity. Upon expiration of the predefined duration, the gaming servers 102 can gauge the community's response based on, for example, the number of views, comments, ratings or reposts that have accumulated during the waiting period. In further alternatives, the gaming servers 102 may continuously or periodically assess the measured effect of the web activity by observing the community's comments or responses to the web activity in predefined intervals of time.

In still further modifications, the gaming server processors 112 can be adapted to generate a more streamlined approach for assessing the measured effect of web activities. More specifically, the gaming server processors 112 may apply one or more preprogrammed functions, mathematical equations, lookup tables, or the like, configured to calculate numerical indices corresponding to the measured effect of web activities based on various metrics, such as the effective quality, tone, word count, sentence structure, view count, page rank, viewability, ratings, and any other quantifiable aspect of the web activity. One or more of the metric values can be obtained through data received directly from the community servers 104 over one or more networks 108 and/or indirectly received through any third-party services commercially available in the art. One or more of the metrics may also be internally resolved by the gaming servers 102 using any data accessible thereto. Additionally, the gaming servers 102 may incorporate a different preprogrammed function, or a different set of functions, for each social network or virtual community in order to accommodate for the various different mechanisms used by different social networks and virtual communities to enable interactions between its members. Each of the different functions can further be scaled and/or calibrated relative to one another so as to produce measured effect indices or results that can be more universally compared.

Converting Measured Effects Into Gaming Incentives

Once the measured effect of a web activity is assessed, the gaming servers 102 can convert the measured effect into a corresponding gaming incentive for the registrant initiating the web activity. More specifically, the gaming servers 102 may issue a gaming incentive having a beneficial value to the registrant that is proportional to or otherwise corresponding to the level of interaction or response received in association with the web activity. The gaming incentives may be issued solely to the registrant, to a registered group to which the registrant belongs, or otherwise beneficial to the registrant. The gaming incentives can also be issued to be usable with the specific gaming service the registrant is participating in, a gaming service the registrant's group is participating in, or to be usable with any of the other gaming services that is sourced by the gaming servers 102. The gaming incentives can include any one or more of gaming credits, gaming entries, points, rewards, tokens, play times, prizes, and the like.

The value of the gaming incentives issued to registrants can be varied by the quantity of incentives issued and/or by the quality of the incentives or rewards given. Moreover, the value of the gaming incentive issued may correspond directly to the measured effect of the web activity assessed. For example, preprogrammed functions used for calculating a numerical index corresponding to the measured effect and/or assessed quality of a web activity can further be modified to calculate a corresponding gaming incentive value index to be issued. The incentive value index may correspond to the total beneficial value a gaming incentive is likely to have on a registrant. Furthermore, each type of gaming incentive issuable may have a predefined unit value associated therewith. Accordingly, the quantity and/or the type of gaming incentives to be distributed to a particular registrant may be selected based on the total beneficial value and the corresponding unit values of the available gaming incentives that are allowed to be issued. In other words, the registrant may be issued a combination of credits, rewards, and the like, which amounts to or approximates the total beneficial value, or the incentive value index previously calculated.

Algorithms/Methods for Converting Measured Effects Into Gaming Incentives

Figure 4:
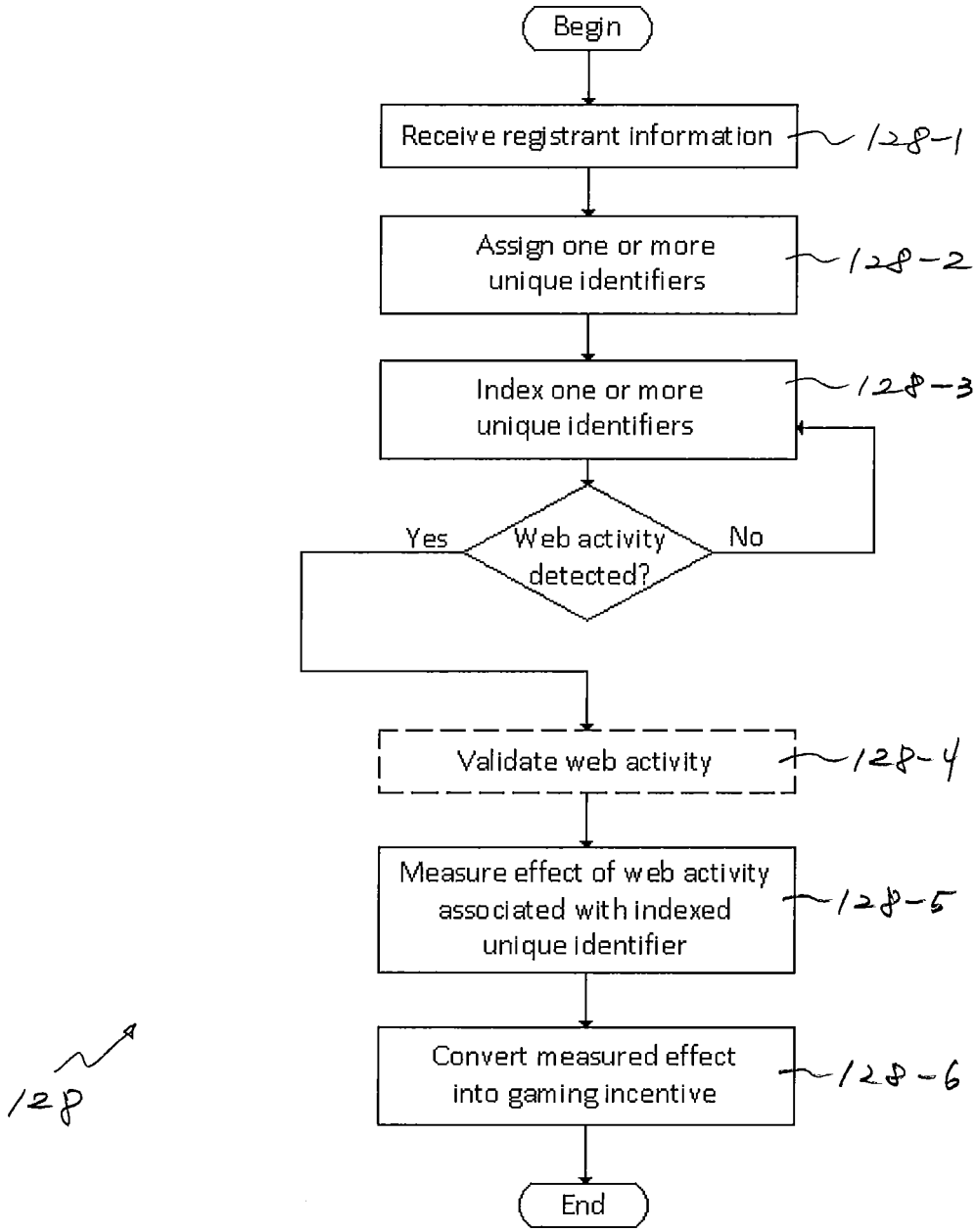
FIG. 4 is a flowchart for an algorithm that corresponds to instructions executed by one or more processors of a gaming server in accord with at least some aspects of the disclosed concepts.

Turning to FIG. 4, one exemplary embodiment of an algorithm or method 128 by which one or more of the processors 112 of the gaming servers 102 may be configured to operate is provided. The processors 112 can include any one or more of a controller, a microcontroller, a microprocessor, a central processing unit (CPU), a field programmable gate array (FPGA), a digital signal processor (DSP), or any other suitable means for electronically controlling functionality of the gaming servers 102. Instructions for operating the one or more processors 112 of the gaming servers 102 are provided within a memory 114, such as a read only memory (ROM), random access memory (RAM), magnetic disk storage media, optical storage media, flash memory, or the like, that is locally or remotely disposed in communication with the gaming servers 102 as is commonly held in the art.

As shown in FIG. 4, the one or more processors 112 of the gaming servers 102 in step 128-1 are initially configured to receive information from a new registrant or a group of new registrants through one or more client devices 106. More specifically, the gaming server processors 112 supply data which can be communicated to and downloaded by the client devices 106 over one or more networks 108 to generate and display registration interfaces 126 using, for example, a web browser, a standalone application or program, or the like, within the client devices 106. Through the registration interface 126, and using one or more input devices 116 of a computational device 110 of the client 106, a new registrant can input registration information, such as the registrant's name, age, preferences, billing information, telephone number, home mailing address, electronic mailing address, and the like. If applicable, the registrant can also select and input a desired alias, username, screen name, login, or the like, that is unique to the registrant. Any or all of the information submitted by the registrant is communicated back to the gaming servers 102 and stored within a database or memory 114 that is managed by one or more processors 112 of the gaming servers 102.

Based on the information received from the registrant, the gaming server processors 112 may be configured to assign one or more unique identifiers to the registrant in step 128-2. In particular, the gaming servers 102 may associate any one or more of the alias, username, screen name, login and electronic mailing address received from the registrant in step 128-1 as the unique identifiers of the registrant or the registrant's account. Alternatively or additionally, the gaming server processors 112 can separately generate one or more unique identifiers for the registrant using any string or combination of numeric, alphabetic and alphanumeric characters. Moreover, the processors 112 generate one or more unique identifiers that are not only indexable but also specific to the particular registrant such that any web activities initiated or submitted by the registrant can be tracked through social or virtual community servers 104 and traced back to the registrant. Similarly, the processors 112 can be adapted to generate a set of unique identifiers for a registered group of registrants so as to track the activities of the individual members of the group. One or more of the unique identifiers may be visibly recognizable and included within the content of each web activity initiated by the registrant, or alternatively, not publicly viewable but internally associated with the web activity and traceable by the gaming servers 102.

Once the unique identifiers have been assigned to a particular registrant or to a group of registrants, the processors 112 of the gaming servers 102 are configured to index the unique identifier strings through the one or more networks 108, as shown in step 128-3 for example, to monitor for any web activity that is initiated by the registrants. More particularly, the processors 112 of the gaming servers 102 may index sets of unique identifiers, where each unique identifier set is assigned to a registrant or a group of registrants registered to one or more gaming services supplied by the gaming servers 102, through one or more social or virtual community servers 104, as well as any other third-party server, using scrapers, crawlers, engines, or any other suitable means available to the gaming servers 102. The indexing step 128-3 may be repeated at predefined intervals of time or continuously performed until a predefined duration of time is expired.

If any unique identifier is returned and recognized as being associated with a potentially valid web activity during the indexing step 128-3, the processors 112 may be configured to validate the web activity in an optional step 128-4. In particular, the gaming server processors 112 may view the contents of the web activity found in association with the detected unique identifiers to determine if the web activity meets a predefined set of requirements or conditions. While other forms of web activities may have different criteria, the processors 112 may examine web activities having text-based formats, such as indexable web postings, messages, blogs, comments, status updates, reviews and ratings, with respect to word count, tone, effective quality, sentence structure, and the like. The processors 112 can also be configured to determine and base the validity of a web activity on the viewability thereof. The viewability of a web activity is calculated based on one or more of a degree of exposure of the web activity, traffic, a popularity of the web site in which the web activity was initiated or page rank, a number of feedback from other members of the social or virtual community, and the like.

If a unique identifier of a registrant is recognized, and if an associated valid web activity is detected, one or more of the processors 112 of the gaming servers 102 may be configured to measure an effect of the web activity as shown in step 128-5 of FIG. 2. Moreover, similar to the validating step 128-4, the processors 112 can quantify or gauge the effect of a web activity based on any one or more of a variety of metrics including, for example, word count, tone, effective quality, sentence structure, view count, page rank, viewability, ratings, and the like. The processors 112 of the gaming servers 102 can also be preprogrammed with one or more customized rule sets with which to gauge certain factors or traits of a web activity for the purposes of assessing the effective quality of the web activity. The results of the assessments, such as the outputs of the rule sets, or derivations therefrom, can then be at least partially applied to one or more of the gaming services provided through the gaming servers 102 by a gaming service provider.

In other implementations, the processors 112 may be preprogrammed with, or the algorithm 128 of FIG. 4 can be configured to include, specialized subroutines for assessing the effective quality of a web activity based on the detected tone of one or more messages and/or sentences contained within the web activity. The processors 112 can also be preprogrammed with filters which monitor for and detect certain keywords, punctuations, font types, text sizes, word sequence, sentence structure, phrases, and the like, that are indicative of a web activity with a higher level of quality as defined by rule sets preprogrammed within the gaming servers 102. Other user-specific or specialized techniques can similarly be applied by the processors 112 to gauge the effective quality of a web activity initiated by one or more of its registrants.

Additionally, the measured effect of a web activity can be quantified based on a preprogrammed equation, lookup table, or the like, which takes a variety of different metrics into consideration. As one example, a web activity that is posted within a web site belonging to a top-ranked and openly viewable online community with active members will have a significantly greater measured effect than a web activity that is posted within a web site belonging to a low-ranked and private virtual community with only a few active members. However, the posting in the low-ranked community page may still have a greater measured effect than the posting in the top-ranked community page if the posting in the low-ranked page receives significantly more referrals, feedback, comments, and the like, from other members within the community.

In step 128-6, the processors 112 of the gaming servers 102 may be configured to convert the measured effect of the web activity gauged during step 128-5 into a gaming incentive for the registrant initiating the web activity. The gaming incentive issued by the gaming servers 102 may include any one or more of gaming credits, gaming entries, points, rewards, tokens, play times, prizes, or any other suitable incentive configured to benefit the registrant and promote gameplay.

The gaming incentive can be configured to be usable only by the registrant initiating the web activity, or by other registered members of a group associated with the registrant. Furthermore, the gaming incentive can be configured to be exclusively applicable to only those specific wagering games, games of chance, contests, sweepstakes, or other gaming services mentioned in the web activity. Alternatively, the gaming incentive can be issued in the form of more generalized play credits, entries, or the like, which enable the registrant or a group of registrants to freely use the gaming incentive toward any other gaming service provided by the gaming servers 102.

In addition, the value of the gaming incentive issued to a registrant can be variably adjusted according to the measured effect of the web activity determined during step 128-5. More particularly, a registrant initiating a web activity with a highly valued measured effect will receive a greater reward or more gaming incentives than a registrant initiating a web activity with a much lower measured effect value. The value of a gaming incentive can be varied in terms of quantity, for instance, the number of play credits or game entries issued, or in terms of quality, for instance, the type of incentive or reward given. The processors 112 of the gaming servers 102 may also be configured to continuously or periodically track any changes in the measured effect of a previously detected web activity and issue gaming incentives giving the registrant a beneficial value which corresponds to the changed measured effect.

Each of these embodiments and obvious variations thereof is contemplated as falling within the spirit and scope of the present disclosure as defined and set forth in the following claims. Moreover, the present concepts expressly include any and all combinations and subcombinations of the preceding elements and aspects.

What is claimed is:

1. A gaming system comprising:

at least one gaming server, each of the at least one gaming server having at least one processor and at least one memory device storing instructions that, when executed by the at least one processor, cause the at least one gaming server to:

assign one or more unique identifiers to a registrant, monitor for web activity associated with the one or more unique identifiers and initiated by the registrant, measure an effect of the web activity based on a predefined metric pertaining to an effective quality of the web activity, and convert the measured effect into a gaming incentive having a value based on the measured effect of the web activity.

2. The gaming system of claim 1, wherein the at least one gaming server is configured to communicate with at least one client over at least one network, the at least one client being provided on at least one computational device having at least one input device and at least one output device, the instructions of the at least one gaming server being configured to at least provide an interface to the registrant through the at least one output device, and receive registrant information from the at least one input device through the interface.

3. The gaming system of claim 2, wherein the at least one client is configured to facilitate registrant initiation of the web activity through the at least one computational device.

4. The gaming system of claim 2, wherein the at least one gaming server is configured to assign the one or more unique identifiers based at least partially on the registrant information.

5. The gaming system of claim 1, wherein the at least one gaming server is configured to assign the one or more unique identifiers as including one or more of a username, a screen name, an alphanumeric code, an electronic mailing address, and a login associated with the registrant.

6. The gaming system of claim 1, wherein the at least one gaming server is configured to communicate with at least one community server associated with at least one virtual community over at least one network, the at least one gaming server using the one or more unique identifiers to index the at least one community server for web activities initiated by registrants.

7. The gaming system of claim 1, wherein the at least one gaming server is configured to monitor for web activities including one or more of an indexable web posting, message, blog, comment, status update, review and rating.

8. The gaming system of claim 1, wherein the at least one gaming server is configured to validate the web activity based one or more of word count, tone, sentence structure and viewability prior to measuring the effect thereof.

9. The gaming system of claim 1, wherein the effective quality of the web activity is based on one or more of word count, tone, sentence structure, view count, page rank, viewability and ratings.

10. The gaming system of claim 1, wherein the at least one gaming server is configured to issue the gaming incentive to the registrant associated with the web activity, the gaming incentive being applicable to one or more gaming services provided by the at least one gaming server and including one or more of gaming credits, gaming entries, points, rewards, tokens, play times and prizes.

11. A computer-implemented method for a gaming system having game logic circuitry including one or more central processing units and one or more memory devices, the method comprising:

receiving registrant information from a registrant through one or more input devices of a computational device;

assigning, via the game logic circuitry, one or more unique identifiers to the registrant;

measuring, via the game logic circuitry, an effect of a web activity initiated by the registrant and associated with the one or more unique identifiers, the measured effect being based on a predefined metric pertaining to an effective quality of the web activity; and converting, via the game logic circuitry, the measured effect into a gaming incentive having a value based on the measured effect of the web activity.

12. The computer-implemented method of claim 11, further indexing one or more community servers associated with at least one virtual community for the one or more unique identifiers to detect the web activity.

13. The computer-implemented method of claim 11, wherein the registrant information is received at one or more gaming servers, the one or more gaming servers being in communication with the computational device over at least one network.

14. The computer-implemented method of claim 11, wherein the web activity is initiated by the registrant in the form of one or more of an indexable web posting, message, blog, comment, status update, review and rating.

15. The computer-implemented method of claim 11, wherein the effective quality of the web activity is based on one or more of word count, tone, sentence structure, view count, page rank, viewability and ratings.

16. The computer-implemented method of claim 11, wherein the gaming incentive is issued to the registrant and includes one or more of gaming credits, gaming entries, points, rewards, tokens, play times and prizes.

17. The computer-implemented method of claim 11, further validating each web activity prior to measuring the effect thereof, each web activity being validated based on one or more of word count, tone, sentence structure and viewability.

18. A non-transitory tangible machine-readable storage media including instructions which, when executed by one or more processors, cause the one or more processors to perform operations comprising:

assigning one or more unique identifiers to a registrant based on registrant information received from a computational device over at least one network;

monitoring one or more community servers of at least one virtual community for web activity associated with the one or more unique identifiers and initiated by the registrant;

measuring an effect of the web activity based on a predefined metric pertaining to an effective quality of the web activity; and converting the measured effect into a gaming incentive for the registrant, the gaming incentive having a value based on the measured effect of the web activity.

19. The non-transitory tangible machine-readable storage media of claim 18, wherein the effective quality of the web activity is based on one or more of word count, tone, sentence structure, view count, page rank, viewability and ratings.

20. The non-transitory tangible machine-readable storage media of claim 18, wherein the web activity is indexed from the one or more community servers by the one or more unique identifiers, and the gaming incentive is issued to the registrant in the form of one or more of gaming credits, gaming entries, points, play times and prizes that are applicable to one or more gaming services provided by one or more gaming servers.

* * * * *